United States Patent [19]

Casey

[11] Patent Number: 4,864,499

[45] Date of Patent: Sep. 5, 1989

[54] PERFORMANCE MOTIVATIONAL GAME

[76] Inventor: William W. Casey, 435 E. 79th St., New York, N.Y. 10021

[21] Appl. No.: 938,538

[22] Filed: Dec. 5, 1986

[51] Int. Cl.[4] ..... G07F 17/34

[52] U.S. Cl. ..... 364/412; 273/138 A; 364/410

[58] Field of Search ..... 364/410, 411, 412; 273/138 A

[56] References Cited

U.S. PATENT DOCUMENTS 4,448,419 5/1984 Telnaes ..... 273/138 X 4,679,143 7/1987 Hagiwara ..... 364/412

FOREIGN PATENT DOCUMENTS 2106294 4/1983 United Kingdom ..... 273/138 A

*Primary Examiner*—Jerry Smith

*Assistant Examiner*—Steven G. Kibby

*Attorney, Agent, or Firm*—Cooper & Dunham

[57] ABSTRACT

A performance motivational game comprises a computer having a keyboard, CRT, storage memory, CPU, and a diskette drive for reading a program on a diskette. The control program awards dollar awards ranging from 1 to 100 dollars, with the average value being selectable to be 1, 2, 3, 4, 5 or 10 dollars. Payout schedules are generated for each of the available average values and are stored on the diskette.

12 Claims, 3 Drawing Sheets

```
⊥IAAAEFEAHAAEHAAJGAFAFEAFAEGAFAAE⊥AIAHAGEFJAFAAEAFAFFEGEAEEAAAAAHA⊥AEIAJFEGAEEEFAAA
 HFAHAAAAFAAFAEGA⊥AJHAAGFFFEEEFAFAAAAAEGHIEAAAAAEA⊥AJFFGEHGIFEAFAAAEAAAEHEAAAAAAEAF
⊥AJEAEAAIHFAAAFEGFHFAAAEAAAGEFAAE⊥HEGUFEEHFAAEFAIEAEFGAAEAAAAAAAAA⊥EAJEEGHAEAAAAFGI
 AEFAAFAAAEAAFFHA⊥EAAJFEHHIAFGFAEAAEAAAAAGAAEFAEAF⊥AJAAAEAFIEGAAEAFFFAAEEAGAAHAAFHE
⊥AEJHAAAFAAEHAFIEAAGGFEAAAEFEAAFA⊥GAAJEHHAAFEAEIAFAEAAFAEEFAAAFGAA⊥AJEFIAFAAAAFGEAA
 AAFEGAEAAEHAHAFE⊥AJAGFAEAAEAFFAAHIEFAAFHAAAEEEAAG⊥FHAEAEJAAAFAEAIAAAGGFHEAFEAEFAAA
⊥AAJAHEAAFAEHFAGAAIAEEAGFEAAAFAEF⊥HEFAAJAAEGEFAEIAAFEAFAEAGAAFAAAH⊥AFGAHJEAFAAEFAAH
 IAFAEAGEAFAEEAAA⊥HAJAIFAGAFFAAEEAEAAAHFEAAFEGAEAA⊥EFAJGAAGAAHAIAAAFEFEAEEAEAAAHAFF
⊥AFEAFFJEAAIAAAEAGHAGAHAFFEAAEAAE⊥AEJGEAEAFHAGAEAAFEEAIAAFAAAHAFFA⊥AAJIAEAAEGFAFFAH
 HAEEAGAAAFEAEAAF⊥EJEAGAFAFHAAAEFAAAFEAAEHIAAAFEGA⊥AAAEEFAAFAEAFEFAHIEAAAFEGAAHAJAG
⊥AFJFAGEEAAFAAIFHEAEAGAEAAEAHAAFA⊥EAJAFEIAEAEFFHEAAFAAEGAAAHAAGAAF⊥AFAJEFAHAEAFAFAF
 HEIAEAAGAAGEAEAA⊥AJAEFAAFEAAEAGHFEAEAAEAIAFAAHAFG⊥AJAAEAEHFAIGFAFAAFEEEAGAAEFAHAAA
⊥EFAJAGAEAAFAHAEIEAFFAAGAFAEAEAHA⊥EAJAGFIAAAEEAAFEAEHEFFAFAAHGAAAA⊥EAJAAFAEAFAIAFAA
 AGFGHAHEEAAEAEAF⊥FAJAEEAAEGEIAFHAFAFAAGAAHEAAFEAA⊥IEJAFAAAGEFGAFAFHEAAAFAEAEAEAAHA
⊥FGAGJAAAAHAFEFAHEIAEAFAFAAAEEAEA⊥EAAFJAAAAEGEFAHIAAFAGAEAEFAAFAHE⊥
```

⊥ = SUBSET START POINTER

| LETTER | DOLLAR VALUE |
|---|---|
| A | $0 |
| B | 1 |
| C | 2 |
| D | 3 |
| E | 5 |
| F | 10 |
| G | 20 |
| H | 25 |
| I | 50 |
| J | 100 |

FIG. 4

PERFORMANCE MOTIVATIONAL GAME

BACKGROUND OF THE INVENTION

This invention relates to a performance motivational game which has particular application as a motivational tool for inspiring and motivating employees to increase productivity and job skills, and to improve customer relations in performance of their jobs.

It is well known that providing a bonus or incentive system to award employees by ways of cash or the like for their job performance will increase productivity relative to mere requests by management to improve productivity without any incentive. Generally, the more the incentive award unit is tied to the performance, the more noticeable the improvement. Such an incentive system may comprise awarding an employee a fixed amount of cash for a given fixed number of production units, e.g., quantity of items produced or number of customers or transactions handled.

SUMMARY OF THE INVENTION

The present applicant has discovered that, as compared to performance results obtained by awarding a fixed nominal amount of say 1, 5 or 10 dollars for a fixed number of production units, significantly improved employee performance results can be obtained by giving an employee an opportunity to win a much higher award amount per fixed number of production units, while still maintaining the average award amount at the same nominal level of 1, 5 or 10 dollars. In the case where the employer wishes to award an average of 5 dollars for a given number of production units, possible awards may be, for example, 0, 1, 2, 3, 5, 10, 20, 25, 50 and 100 dollars. By controlling the number and frequency of the ten exemplary possible award values, the average award can be kept to virtually any desired value, e.g., 1, 2, 3, 4, 5 or 10 dollars. By giving the employee the opportunity to obtain award levels substantially higher than the average award value, the results in employee performance can be significantly improved (relative to always awarding a fixed amount) while still maintaining the average award value relatively low (equal to the prior fixed amount).

In accordance with the invention, a performance motivational game is provided which implements the principles discussed above. The game comprises input means, display means, CPU, storage means, and control program means. The control program means receives information from management concerning the average award value desired. This average award value information, along with possible award values, which are preferably provided beforehand, is used to output a series of actual award values, one at a time in sequence in response to incremental actuation of the input means, wherein the average value of the series of numbers generated equals the average award value previously selected.

The present applicant has also discovered that employees are very motivated to earn "tries" in the game. The number of tries can be directly and linearly proportional to the number of production units. Alternatively, the number of tries can be related to the number of production units in a geometric progression, or the like, so that a given incremental number of production units earns increasingly more "tries" in the game as the number of production units increases. Applicant has found that this latter method of calculating "tries" in the game has a significantly improved productivity effect on the employees relative to the former method.

The system also preferably generates graphical printouts referred to as performance graphing and goal graphing features. In performance graphing, an employee's actual performance for that payout session, as well as for a number of previous sessions, e.g., 10 previous weekly sessions, is graphically printed out. Graphical results can also be produced for the group of all employees in the same job level. In goal graphing, graphs may also include goal data which have been inputted beforehand and superposed on the performance graph described above. Such graphs, especially when posted in the employees' work area, have proven to have a powerful motivational effect.

In a preferred arrangement of the game according to the invention, management inputs the number of production units the employee has produced. Production units may be the number of items produced, the number of transactions or customers handled, or other quantifiable unit. The system then translates production units, according to a pre-arranged formula into "tries" of the game. Management then lets the employee play the game that specified number of times, and then dispenses to the employee the total award calculated by adding all of the award values received. Preferably, the award values are in units of cash and are dispensed immediately upon the employee finishing his or her play of the game. The system then preferably generates performance graphs with goal graphs as described above. This system has been shown to be a powerful motivational tool, especially when played on a regular basis, with groups of other employees in the same job level, coupled with instruction and demonstration by management on how to improve employee productivity so that the employees will know how to increase their production units for the next session that the game is played.

In a preferred arrangement of the invention, the game comprises an existing computer hardware terminal having a CRT screen, a keyboard, a printer, a central processing unit (CPU) and storage capability including a diskette drive. The control program means are provided primarily by a software program on a diskette. The diskette has stored thereon a number of different schedules, one for each of the average award values to provide a selection by management of an average award value. Each schedule is divided into a number of equally sized subsets with each of the numbers in a subset having a value indicating an actual payout value selected from a set of possible payout values. Each of the possible payout values are repeated a number of times, with the actual payout values being arranged so that the average value of the numbers in each subset is equal to the average value of the numbers of the other subsets within a schedule. However, as noted, the average value associated with each schedule is different from that of the other schedules.

The numbers and subsets within each schedule are arranged in a string with a subset start pointer at the beginning of each subset. The control program means locates a position pointer randomly at one of the subset start pointers in a schedule selected by a user (management) using the input means to indicate which of the average values is desired for a group of employees ready to play the game. The output means displays the value of the number at which the position pointer is located in response to actuation of the input means by the user/employee. The control program means advances the position of the pointer incrementally through the selected schedule upon actuations of the input means, whereby the output means displays in sequence the values of the numbers in the selected schedule in the order in which they are arranged in the string.

In a particular embodiment, six schedules are provided for the average award values of 1, 2, 3, 4, 5 and 10 dollars, and ten possible payout values are provided from the set of 0, 1, 2, 3, 5, 10, 20, 25, 50 and 100 dollars.

BRIEF DESCRIPTION OF THE DRAWINGS

The foregoing and other features of the invention will become more readily apparent from the following description of an illustrative embodiment, appended claims and accompanying drawings, in which:

FIG. 4 is an example payout schedule for a $10 average payout with subset pointers indicated.

DESCRIPTION OF THE PREFERRED EMBODIMENT

Figure 1:
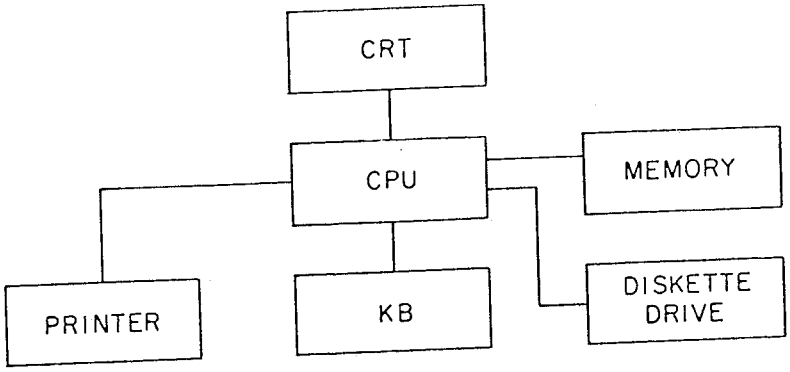
FIG. 1 a block diagram of the game according to the invention.

With reference to FIG. 1, the performance motivational game comprises preferably a computer hardware system including a CRT, keyboard input means, a printer, a central processing unit (CPU) and memory means, including a diskette drive adapted to receive a diskette on which a control program is stored. The particular control program on the diskette should preferably be for a widely used and popular existing computer system such as an IBM PC which includes its own operating system software. The diskette will provide the particular application software for the game according to the invention.

Figure 2:
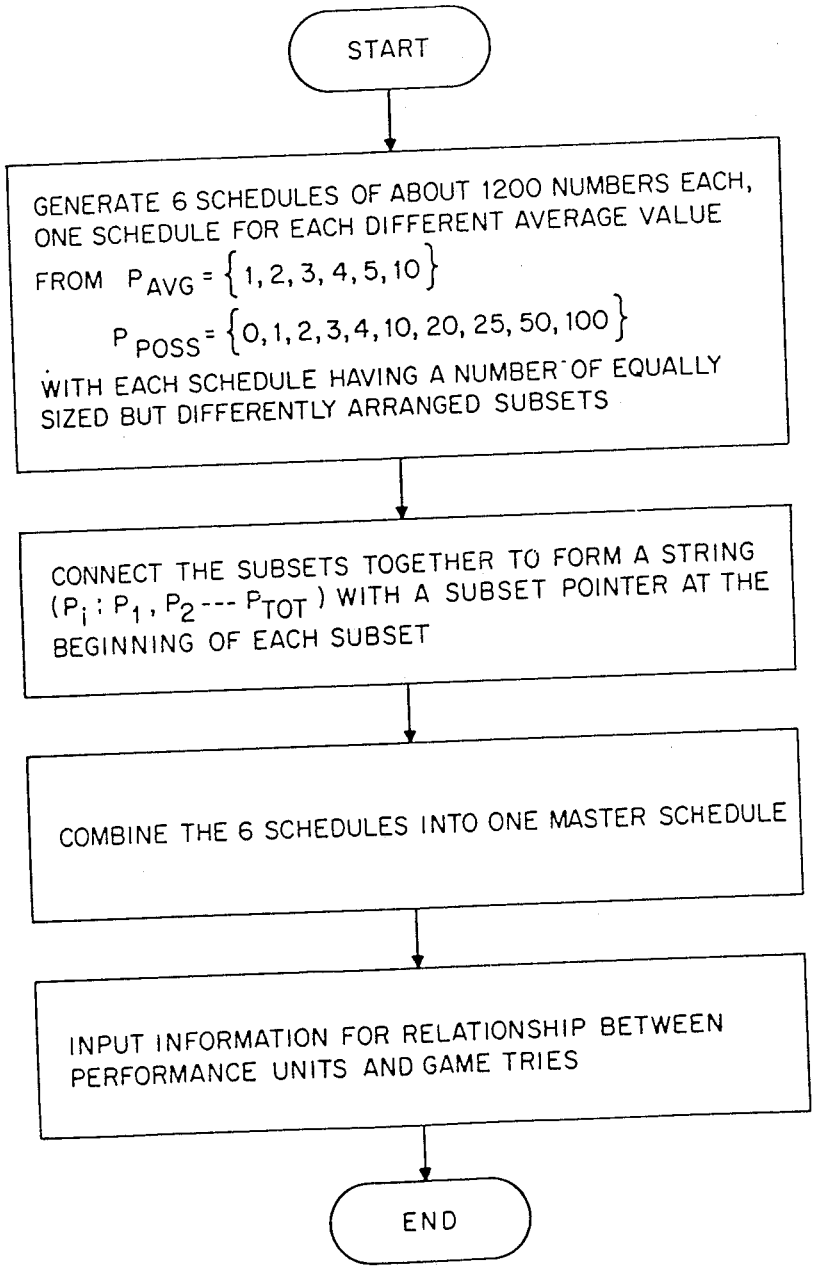
FIG. 2 is a flowchart of steps for generating the payout schedules and other initialization in accordance with the invention.

With reference to FIG. 2, the flowchart for generating the payout schedules will now be described. In a preferred embodiment according to the invention, six payout schedules, one for each of the average payout values, is provided, with each schedule having about 1,200 numbers. After each payout schedule has been generated, the six schedules are combined into one master schedule of about 7,200 numbers which is used during program execution. Each schedule is arranged with a number of subsets, with the numbers within each schedule being divided equally among the subsets for that schedule. Table A shows the number of subsets, numbers per subset and total numbers for all subsets for each of the six payout schedules corresponding to the average payouts of 1, 2, 3, 4, 5 and 10 dollars respectively.

TABLE A

| Average Payout | Total Subsets | Numbers per Subset | Total Numbers (All Subsets) |
|---|---|---|---|
| $ 1 | 4 | 287 | 1148 |
| 2 | 8 | 146 | 1168 |
| 3 | 13 | 88 | 1144 |
| 4 | 20 | 60 | 1200 |
| 5 | 27 | 44 | 1188 |
| 10 | 37 | 32 | 1184 |

As can be seen, the payout schedule for 1 dollar has only four subsets but has a relatively large number of numbers per subset, i.e. 287. On the other hand, the payout schedule for 10 dollars has 37 subsets and only 32 numbers per subset. The average value within each subset is equal to the average value for each of the other subsets within the same schedule, and equals the average payout for that schedule.

Each subset contains a string of numbers, each number being selected from the values of possible payout values $P_{poss.}$, which is defined by the set of (0, 1, 2, 3, 5, 10, 20, 25, 50 and 100). In the 1 dollar average payout schedule, having four subsets of 287 numbers, each subset of 287 numbers has 233 occurrences of $0, 24 of $1, 12 of $2, 8 of $3, 5 of $5, 2 of $10, 1 of $20, 0 of $25, 1 of $50 and 1 of $100, giving a total of $287 for 287 occurrences. Each of the four subsets are generated separately and each order of the presentation is uniquely different from the other subsets. The other payout schedules are constructed in a similar manner. A subset pointer is provided at the beginning of each subset, and the subsets within each schedule are strung together to form that schedule. The six schedules are then combined together into one master schedule of about 7,200 numbers.

The information to determine the number of game "tries" based on the number of employee performances is also inputted. This relationship can be set up in one of two methods in the preferred embodiment. In the first method ("calculate" or linear method) the system simply performs a simple arithmetic division computation to determine the number of tries ("T") given the number of performance units ("PU"). At this stage then, the information input may simply be a constant ("K") in the relationship T=PU/K. For example, for K=3, each 3 performance units (PU) results in one try (T) on the game (0-2 PU's=1 try, 3-6 PU's=2 tries etc.).

In the second method ("table" or "geometric" method) a table stores data representative of a geometric progression relationship between performance units (PU's) and tries (T). A typical table might be the following:

TABLE B

| No. of Performance Units (PU) | No. of Tries (T) |
|---|---|
| 0–3 | 0 |
| 4 | 1 |
| 5 | 2 |
| 6 | 4 |
| 7 | 7 |
| 8 | 11 |
| 9 | 16 |
| 10 | 22 |

The supervisor of the employees can establish the values he or she desires in the Table B. A geometric progression relationship between PU and T as shown in Table B has been shown to be a strong motivating tool.

Figure 3:
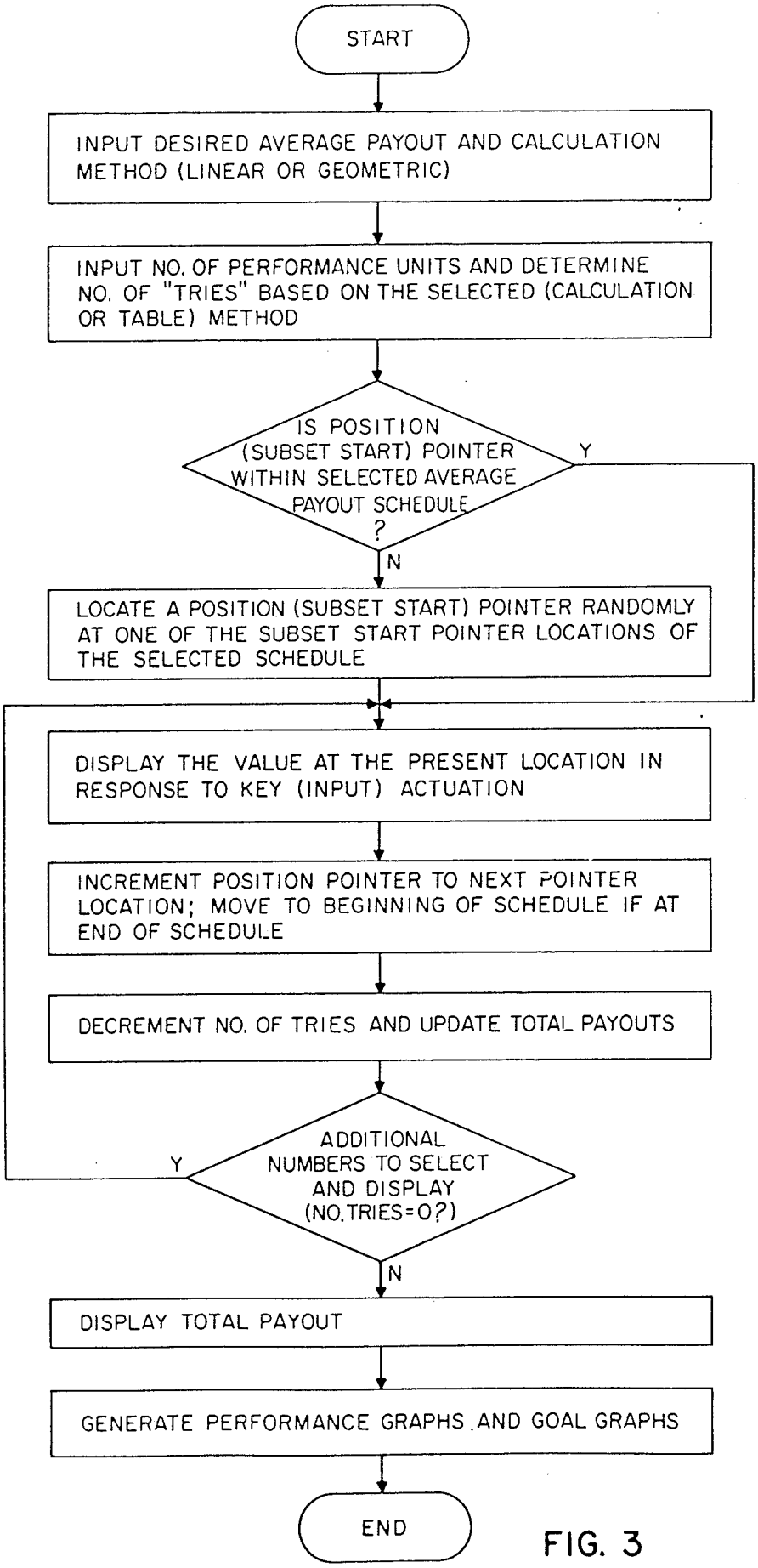
FIG. 3 is a flowchart of steps for execution of the control program.

Referring now to FIG. 3, the execution of the program will now be described. The average payout value, number of performance units by a particular employee ready to play the game, and the method for calculating the number of tries are selected by management. A starting point within the schedule for the average payout is randomly selected to be the start of one of the subsets for that particular schedule. In particular, the start of each subset is provided with a subset pointer, and the starting point is selected randomly to be one of these subset pointers. For the 1 dollar average payout schedule, the starting pointer may be located at any one of the four subset pointers. In response to a first actuation of a key by a user/employee playing the game, the number in the selected schedule which is the beginning of the randomly selected subset will be displayed. After this value has been displayed the position pointer is incremented to the next pointer location and the next number in the subset will then be displayed in response to a key actuation by the user/employee. Since the subsets are connected together to form a string, after the last number in a particular subset has been displayed, the position pointer will move to the first number in the next occurring subset. However, if the position pointer is at the last number of the last subset in the schedule, the position pointer will be moved to the first number in the first subset in the schedule. The pointer thereby maintains a continuous loop on the average payout schedule for the average payout selected.

The game keeps track of the number of tries allowed by each player and decrements the tries remaining by one for each try completed. Total payouts are also tracked. Once the number of tries remaining reaches zero, the total payouts are displayed and the game generates performance and goal graphs as described above.

Once all of the employees have played the game for a particular session, the computer can be turned off, and the pointer location will be stored and retained for future restart, assuming the same average payout schedule will be selected.

The applicant has discovered that the game when used as a motivational tool results in high initial interest by the employees if the actual payouts are initially high relative to the average payouts. Accordingly, the values of numbers in each subset may be arranged to provide a higher average value in an initial portion of the subset than in a latter portion of the subset.

Numerous variations and modifications will occur to those readily skilled in the art. Accordingly, the invention is not intended to be limited to the particular embodiment illustrated and described.

I claim:

1. A performance motivational game wherein players are awarded a single payout amount from a set of possible payout amounts in response to each actuation of input means, and wherein the average value of the payout amounts may be preselected from a set of possible average values, comprising means for storing a plurality of schedules of numbers, each schedule being divided into a number of subsets with the numbers distributed substantially equally among the subsets, wherein each of said numbers has a value indicating a payout value selected from a set of payout values, and wherein the values of the numbers are selected so that the average value of the numbers in each subset is substantially equal to the average value of the numbers of the other subsets within a schedule, but wherein the average value associated with each schedule is different from that of the other schedules, the numbers and subsets within each schedule being arranged in a string with a subset start pointer at the beginning of each subset;

manually actuable input means for selecting a schedule having a desired average value;

control program means for locating a position pointer randomly at one of the subset start pointers in a selected schedule;

output means for displaying the value of the number at which the position pointer is located;

said control program means advancing the position pointer incrementally through the selected schedule upon actuations of said manually actuable input means, whereby the output means displays in sequence the values of the numbers in the selected schedule in the order in which they are arranged in the string, said values of said number representing payout values.

2. The performance motivational game according to claim 1, wherein the values of numbers in each subset are arranged to provide a higher average value in an initial portion of said subset than in a latter portion of said subset.

3. The performance motivational game according to claim 1 wherein the sequence and arrangement of numbers in each subset is different for different subsets in the same schedule.

4. The performance motivational game according to claim 1 wherein the total number of numbers in each schedule is different for the different schedules.

5. The performance motivational game according to claim 1 wherein the control means, upon reaching the last number in the schedule, moves the position pointer to the first number in the same schedule.

6. The performance motivational game according to claim 1 wherein the highest number in each subset and schedule is at least ten times greater than the average value in the schedule.

7. The performance motivational game according to claim 1 wherein the highest number in each subset appears once in each subset.

8. The performance motivational game according to claim 1 further including means for determining the number of input actuations allowable for a player based on a number of performance units achieved by that player.

9. The performance motivational game according to claim 8 including memory means for storing information representing a geometric progression relationship between the number of performance units and the number of input actuations allowable.

10. The performance motivational game according to claim 8 further including memory means for storing the total number of performance units for each player for at least several previous game sessions during which the game was played, and printer means for generating a graphical representation of the performance units for each of said sessions.

11. The performance motivational game according to claim 10 wherein the memory means also stores goal data indicating a number of performance units previously inputted as a goal for each player, and wherein the printer means also generates a graphical representation of the goal performance units.

12. The performance motivational game according to claim 1 wherein the control program means calculates the sum of all payout value obtained by a player of the game.

* * * * *